US009103131B2

(12) United States Patent
Domage

(10) Patent No.: US 9,103,131 B2
(45) Date of Patent: Aug. 11, 2015

(54) METHOD AND SYSTEM FOR EQUALLY TENSIONING MULTIPLE STRANDS

(75) Inventor: Jean-Baptiste Domage, Marly le Roi (FR)

(73) Assignee: VSL INTERNATIONAL AG, Koniz (CH)

( * ) Notice: Subject to any disclaimer, the term of this patent is extended or adjusted under 35 U.S.C. 154(b) by 402 days.

(21) Appl. No.: 13/515,002

(22) PCT Filed: Dec. 24, 2009

(86) PCT No.: PCT/EP2009/067920

§ 371 (c)(1), (2), (4) Date: Oct. 29, 2012

(87) PCT Pub. No.: WO2011/076287

PCT Pub. Date: Jun. 30, 2011

(65) Prior Publication Data

US 2013/0140509 A1 Jun. 6, 2013

(51) Int. Cl.

*B21F 9/00* (2006.01)
*B66F 3/00* (2006.01)
*E04G 21/12* (2006.01)

(52) U.S. Cl.

CPC ..... *E04G 21/12* (2013.01)

(58) Field of Classification Search

USPC ..... 254/228, 242, 246, 263, 392, 393
See application file for complete search history.

(56) References Cited

U.S. PATENT DOCUMENTS

| | | | | | |
|---|---|---|---|---|---|
| 328,720 | A | * | 10/1885 | Schuster | 254/223 |
| 2,328,364 | A | * | 8/1943 | Taylor | 73/862.42 |
| 2,637,895 | A | * | 5/1953 | Blaton | 29/452 |
| 2,751,660 | A | * | 6/1956 | Nakonz | 264/228 |
| 3,023,475 | A | * | 3/1962 | Yerby et al. | 425/111 |
| 3,072,361 | A | * | 1/1963 | Fuller | 242/155 M |
| 3,090,598 | A | * | 5/1963 | Paul | 254/29 A |
| 3,597,830 | A | * | 8/1971 | Yegge | 29/452 |
| 3,658,296 | A | * | 4/1972 | Yegge | 254/29 A |
| 3,844,023 | A | * | 10/1974 | Surribas et al. | 29/452 |
| 3,868,850 | A | * | 3/1975 | Davison et al. | 73/862.42 |
| 3,964,154 | A | * | 6/1976 | Auer | 29/452 |

(Continued)

FOREIGN PATENT DOCUMENTS

| | | |
|---|---|---|
| EP | 0304376 | 2/1989 |
| EP | 0421862 | 4/1991 |

(Continued)

OTHER PUBLICATIONS

International Search Report for PCT/EP2009/067920 dated Aug. 10, 2010.

*Primary Examiner* — Emmanuel M Marcelo
*Assistant Examiner* — Michael Gallion
(74) *Attorney, Agent, or Firm* — Pearne & Gordon LLP

(57) ABSTRACT

A method and system are described for tensioning structural strands 1 of a tendon in a duct. Each strand 1 is fitted with its own load cell 22, so that the individual tension values in each individual strand 1 can be measured during the tensioning of the strands 1. The load cells 22 may be removed after tensioning, or left in situ to enable ongoing monitoring of the tension in the strands 1. The load cells 22 may be calibrated simultaneously by tensioning the strands 1 to an equal tension using individual jacks 10, then normalizing the signals from each load cell 22 to the known equal tension value. A further calibration to a global strand load measurement may also be performed.

21 Claims, 8 Drawing Sheets

(56) References Cited

U.S. PATENT DOCUMENTS

| | | | | | |
|---|---|---|---|---|---|
| 4,068,963 | A * | 1/1978 | Brandestini | 403/268 |
| 4,302,978 | A * | 12/1981 | Dykmans | 73/828 |
| 4,347,993 | A * | 9/1982 | Leonard | 242/413.3 |
| 4,372,535 | A * | 2/1983 | Gibson et al. | 254/319 |
| 4,485,677 | A * | 12/1984 | Amelot et al. | 73/761 |
| 4,508,251 | A * | 4/1985 | Harada et al. | 226/25 |
| 4,546,656 | A * | 10/1985 | Grundy et al. | 73/862.473 |
| 4,649,753 | A * | 3/1987 | Goodsmith | 73/865.8 |
| 4,718,168 | A * | 1/1988 | Kerr | 33/735 |
| 4,805,877 | A * | 2/1989 | Hoekstra | 254/29 A |
| 4,960,001 | A * | 10/1990 | Vemmer | 73/862.392 |
| 5,083,469 | A * | 1/1992 | Percheron et al. | 73/862.42 |
| 5,718,090 | A * | 2/1998 | Wei-Hwang | 52/223.14 |
| 5,809,710 | A * | 9/1998 | Jungwirth et al. | 52/223.1 |
| 6,248,030 | B1 * | 6/2001 | Pierce | 473/493 |
| 6,296,232 | B1 * | 10/2001 | Roodenburg | 254/392 |
| 6,457,666 | B1 * | 10/2002 | Niederer | 242/419.9 |
| 6,598,859 | B1 * | 7/2003 | Kureck et al. | 254/292 |
| 6,944,550 | B2 * | 9/2005 | Marchetti | 702/42 |
| 8,001,852 | B2 * | 8/2011 | Laurent et al. | 73/862.451 |
| 8,702,066 | B2 * | 4/2014 | Steidinger et al. | 254/228 |
| 2004/0094651 | A1 * | 5/2004 | Marchetti | 242/410 |
| 2005/0055974 | A1 * | 3/2005 | Lecinq et al. | 52/741.1 |
| 2006/0201100 | A1 * | 9/2006 | Langwadt et al. | 52/741.1 |
| 2008/0093176 | A1 * | 4/2008 | Rosenthal | 187/241 |
| 2009/0083956 | A1 * | 4/2009 | Ulfik et al. | 24/68 D |
| 2010/0315076 | A1 * | 12/2010 | Tsukada et al. | 324/209 |
| 2011/0168960 | A1 * | 7/2011 | Steidinger et al. | 254/228 |
| 2013/0152496 | A1 * | 6/2013 | Sinclair | 52/223.13 |

FOREIGN PATENT DOCUMENTS

| | | |
|---|---|---|
| EP | 0421862 A1 | 4/1991 |
| EP | 0544573 | 6/1993 |
| EP | 0544573 A1 | 6/1993 |

* cited by examiner

METHOD AND SYSTEM FOR EQUALLY TENSIONING MULTIPLE STRANDS

The invention relates to the field of tensioning structural cables, and in particular to tensioning structural cables such that the overall tension on the cable is distributed equally across the cable's component strands.

Pre-stressing cables are used in many structural applications, and in particular for reinforcing concrete structures by holding the concrete in compression. In many applications, the amount of compression applied to the concrete is not critical, and it may be sufficient that the compression is well above a specified minimum, with the cable tension being well below its breaking tension.

However, there are applications where tendons must be tensioned to high specifications and to within narrow tolerances. Such applications include, for example, concrete pressure containment vessels in nuclear power installations, or in gas or oil storage facilities. The integrity of such containments depends to a large degree on the tension in the post-tensioning (PT) tendons, and it is therefore essential for the constructor of such installations to be able to demonstrate that the stressing tendons are tensioned to within the specified tolerances.

A typical PT cable, or tendon, might consist, for example, of 55 strands fed through a duct and tensioned from one or both ends of the duct using hydraulic jacks. Containment vessels may be cylindrical or spherical structures with ducts following a curved path in the concrete. Once the PT strands are stressed to the required tension, the strands are anchored, usually using conical wedges, to an anchor plate. After the installation and tensioning are complete, regular inspection is required throughout the life of the installation to ensure the ongoing integrity of the strands inside the duct, and to ensure that the tension in the strands is still within the specified tolerances. At such inspections, the tendon force can be measured using a so-called lift-off technique, where a jack is used to lift the end anchor. The force required to move the anchor will give an indication of the tension in the bundle of strands which make up the PT cable. For bonded tensioning systems, the lift-off can be performed at any point until the time of grouting; for unbonded tendons, the technique can be performed at any time.

One difficulty with the tensioning of tendons inside a duct is the effect of friction between the strands and the walls of the duct, and friction between the strands themselves. These friction effects can cause an uneven or variable distribution of forces among the strands and/or along the length of each strand during and after the tensioning operation. This problem is especially prevalent in applications which use very long strands, and in non-straight ducts in which the strands are not merely subjected to longitudinal forces, but also to lateral forces which urge the strands together and/or against the duct wall. In a duct of circular cross-section which follows a curved path through the concrete to be stressed, for example, the loosely-distributed strands will be pulled inwards as the slack is taken up, such that all the strands eventually experience a lateral force and a lateral movement along the radius of curvature of the duct path.

It is known in the prior art to perform the tensioning of PT tendons in two phases: a first pre-tensioning, equalisation phase, during which the strands are individually pulled taut, so that all the strands are stressed to the same, relatively low tension, followed by a main tensioning phase, during which the strands are jacked, as one group, to the desired tension.

European patent application EP0421862 describes one such method of tensioning multiple strands to achieve an equal tension on all strands. The method of EP0421862 involves tensioning a reference strand to the desired tension. This is performed using a hydraulic jack to stress the reference strand while measuring the tension on the strand using a load cell. The other strands are then stressed to the force given by the reference load cell. It is assumed that, although the individual stresses on the individual strands will diminish slightly as more strands are tensioned, the individual stresses will nevertheless be equal after stressing.

An alternative method is described in European patent application EP0544573, in which multiple strands are pre-tensioned to around 10% of their final tension using multiple small jacks, one for each strand. The individual pre-tensioning jacks are supplied by the same pressure source, so it is assumed that, once the preliminary tensioning phase is complete, all the slack has been taken up in all the strands, and the strands are all tensioned to the same tension.

This preliminary tensioning phase of EP0544573 and EP0421862 is thus designed to bring all the strands to the same, relatively low tension. Once this phase is complete, the strands are jacked to their full desired tension using a single, large hydraulic jack which tensions all the strands together. It is assumed that, since the strands are all at the same equalised tension at the beginning of the main jacking operation, and since the strands are assumed to be materially identical, the tensions will remain equalized during the main jacking operation. A further assumption is made that the tensions in the individual strands will still be equal once the strands have been fully tensioned and anchored.

As mentioned above, the methods described in the prior art make significant assumptions about the homogeneity of the behaviour of the strands during and after tensioning. In reality, however, the strands are not identical, and their varying orientation relative to each other and to their surroundings means that they are subjected to different forces during the tensioning operations. In particular, individual strands can become tangled or jammed between other strands, or between other strands and the duct wall. If such a jamming occurs, it is quite possible for the tension in a strand to be distributed unevenly along the length of the strand. This may have as a consequence that the tension in one or more strands is locally outside the specified safety or operating tolerances, even though the outward appearance is that the tension in the strand is within the specified or expected range.

If the distribution of tension in a strand is particularly uneven, this can lead to parts of the strand being stressed beyond its operating range during the main tensioning phase, and the strand may break or become overstrained. In some circumstances, such a mechanical failure may happen without being detected, in which case the main jacking operation will proceed with the group of strands including the impaired or broken strand(s). In order to achieve the desired tension on the bundle as a whole, containing one or more strands which are mechanically impaired, the tension in each individual strand will be greater than specified or expected. In this way, the tensioning may appear to be within tolerance, while the individual strands may unwittingly be tensioned beyond their specified limits.

A different situation can also arise during the tensioning phases when a strand becomes trapped at two or more points along its length. During the preliminary tensioning phase, the ends of the strand will be tensioned to the required tension, but there may be a section of the strand, between the two trapping points, where the tension is significantly lower than the tension at the ends of the strand. In such a case, the subsequent main jacking operation can have unpredictable effects on the distribution of tension in the strand concerned.

If one or other of the trapped points becomes unstuck during the second tensioning phase, then the tension in that part of the strand, and consequently in the whole length of the strand, may suddenly change.

Strands can also suffer from mechanical weakness as a result of abrasion or material imperfections. Such mechanical weakness can lead to sudden failure (breakage), or gradual stretching (creep or yield), either of which can lead to a dangerous loss of tension in the group of strands as a whole. If the failure occurs during the main tensioning phase, then the remaining strands will be overloaded to compensate for the weakened on broken strand(s). This is notably a problem where the strands are to be stressed to a tension approaching their maximum operation stress (near their yield stress).

These effects are most likely to manifest themselves during the main tensioning phase, since this is when the most significant changes and movements occur within and between the strands. However, such strand failures or movements can also occur later in the life of the installation—either spontaneously or as a result of some stress event. For this reason, regular inspections are carried out to verify that the tension on the bundle of strands is still within tolerances. Such inspections are normally only performed on the tendon bundle as a whole, however. Inspecting the individual strands is not usually a viable option, although it might in some circumstances be possible to perform a lift-off measurement on each of the strands individually.

The present invention aims to provide a method and system which solves the above and other problems with the prior art.

To this end, the invention provides a method of tensioning a plurality of strands, the method comprising: a first step of arranging a plurality of individual first tension sensing means to determine the individual tension in each individual strand, a second step of individually tensioning each individual strand to a common first tension amount, a third step of, when each strand is tensioned to the same common first tension amount, using the plurality of individual first tension sensing means to determine a first individual tension measurement value for each strand, a fourth step of calibrating to the first tension amount the first individual tension measurement values determined by the plurality of first tension sensing means. The first tension amount may be an arbitrary tension amount at which it can be determined that all the individual jacks have completed the slack uptake in the individual strands, or it may be a predetermined tension value such as, for example, 10% or 15% of the specified final tension.

According to a variant of the method of the invention the method also comprises a fifth step of tensioning the plurality of strands to a second tension amount, and a sixth step of determining, using the individual first tension sensing means, a second individual tension measurement value for each individual strand when the strands are tensioned to the second tension amount. The second tension may be any chosen tension amount during the tensioning process, or it may be a predetermined tension amount such as, for example, 50% or 100% of the required final tension.

The provision of individual tension sensing means such as load cells, for example, on each strand allows an installer to monitor the evolution of the tension in each individual strand during and/or after the first and/or second tensioning steps. Any sticking or jamming or breakage or unequal strand loading can thus be detected at the time it occurs, instead of at the next inspection. The calibration step, because it is performed when all the strands are tensioned to the first tension, enables the normalization of the tension values detected by the load cells to be calibrated to the value of the first tension.

According to a further variant of the method of the invention, the method comprises a seventh step of arranging second tension sensing means to determine the combined tension on the plurality of strands, and an eighth step of comparing the combined tension with individual tension measurement values detected by the first tension sensing means. The individual tension sensing means may, for example, be magnetic load sensors.

According to a further variant of the method of the invention, the method comprises a ninth step of removing the individual tension sensing means after the strands have been tensioned. Alternatively, the plurality of individual load cells may be arranged such that they continue to provide individual tension values for the individual strands after the strands have been tensioned.

The invention also provides a system for tensioning a plurality of structural strands, the system comprising: individual tensioning means for individually tensioning each of the strands to a common first tension amount, a common tensioning means for tensioning the plurality of strands to a second tension, a plurality of individual tension sensing elements arranged to detect individual tension measurement values for each of the strands, and first calibration means for calibrating the individual tension measurement values against the first tension amount.

According to a variant of the system of the invention, the individual tensioning means comprises one or more individual hydraulic jacks, the or each individual hydraulic jack being arranged to tension one strand.

According to another variant of the system of the invention, the individual tensioning means comprises a plurality of individual hydraulic jacks supplied by a common pressure source or by separate sources at a common pressure.

According to another variant of the system of the invention, the individual tensioning means comprises an individual hydraulic jack which can be transferred to successively tension one strand after another. The individual tension sensing elements may be magnetic load sensors.

According to another variant of the system of the invention, the individual tension sensing elements are arranged in one or more common planes orthogonal to a longitudinal axis substantially parallel to the tensioning direction of the strands.

According to another variant of the system of the invention, the individual tension sensing elements are arranged such that they can remain in position to measure the individual tension in the individual strands once the tensioning of the strands has been completed.

According to another variant of the system of the invention, the individual tensioning means and the common tensioning means are the same.

According to another variant of the invention, the system comprises common tension sensing means for determining the common tension on the plurality of strands, and second calibration means for calibrating the individual tension measurement values determined by the individual tension sensing elements against the common tension determined by the common tension sensing means.

The invention is described with reference to tensioning strands within a duct. However, the same techniques can also be applied to strands which are not confined to ducts, such as stay cables. In fact the invention can be implemented for stressing any collection of strands.

The invention will now be described with reference to the attached figures, in which.

Figure 10A:
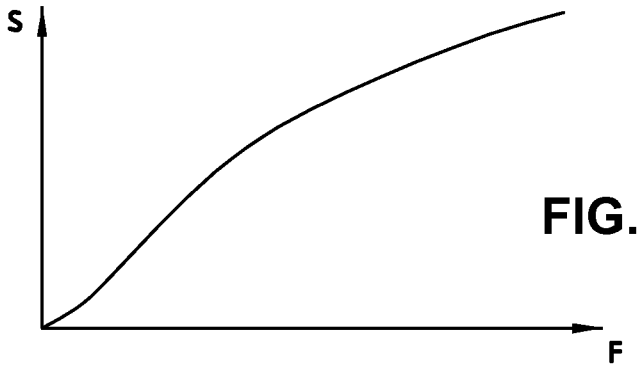
Figure 10B:
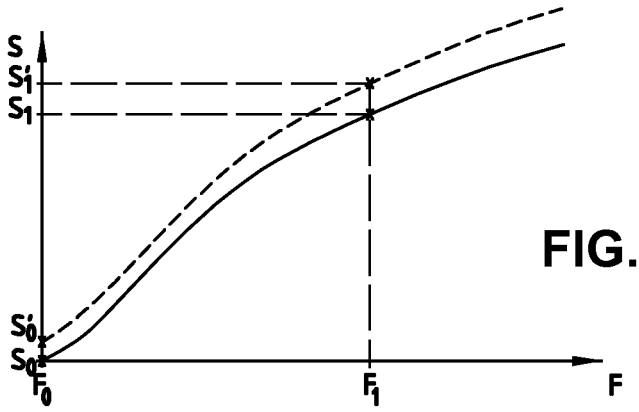
Figure 10C:
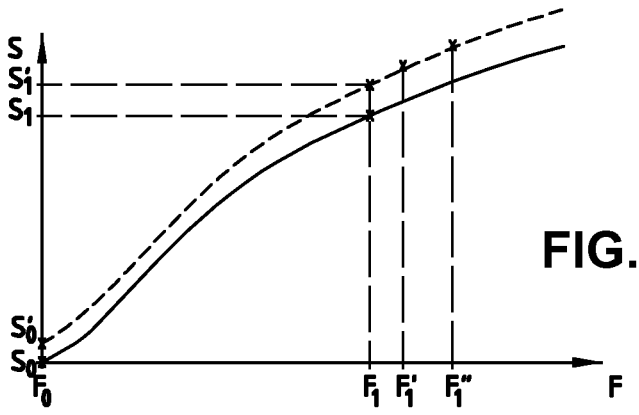

FIGS. 10*a* to 10*c* show a calibration process used in various embodiments and variants of the invention.

Figure 11:
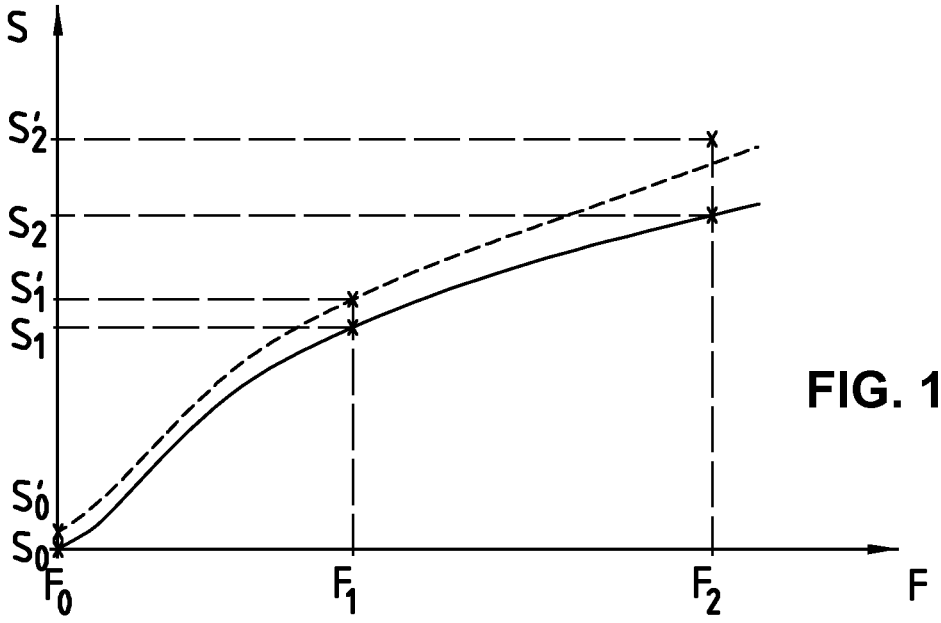

FIG. 11 depicts a graph showing a verification step used in various embodiments of the invention.

Figure 12:
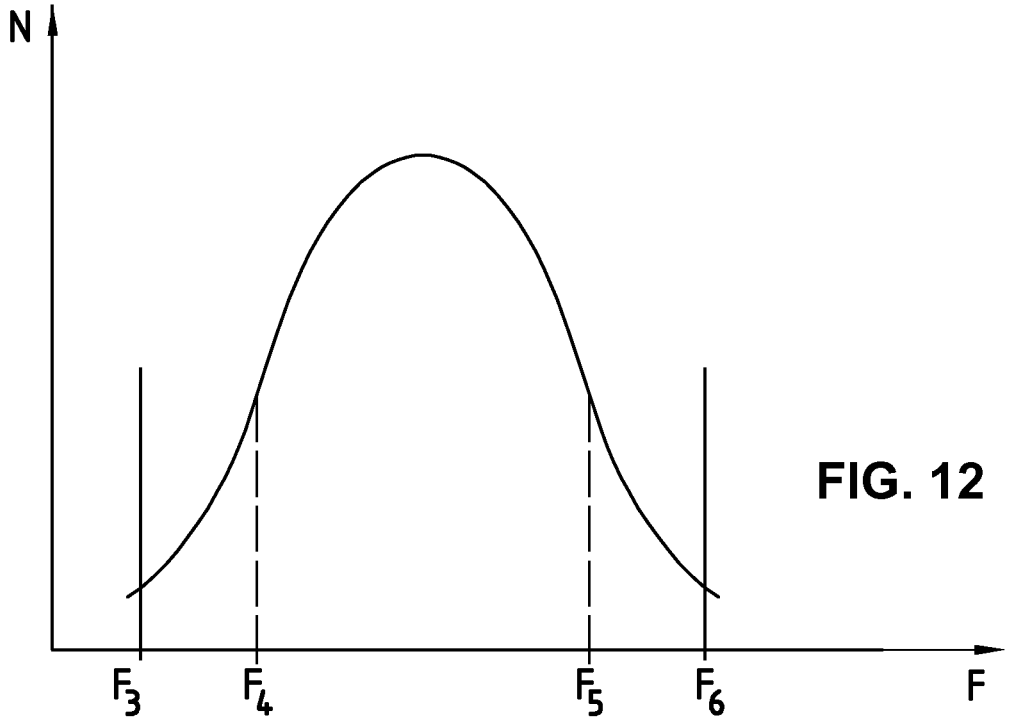

FIG. 12 depicts a population curve showing a distribution of the strand tensions within a PT stressing tendon, for example.

The drawings are provided as an aid to understanding the invention, and should not be taken as limiting the scope of the invention, which is defined in the attached claims. The same reference numerals used in different figures are intended to refer to the same or corresponding features.

Figure 1:
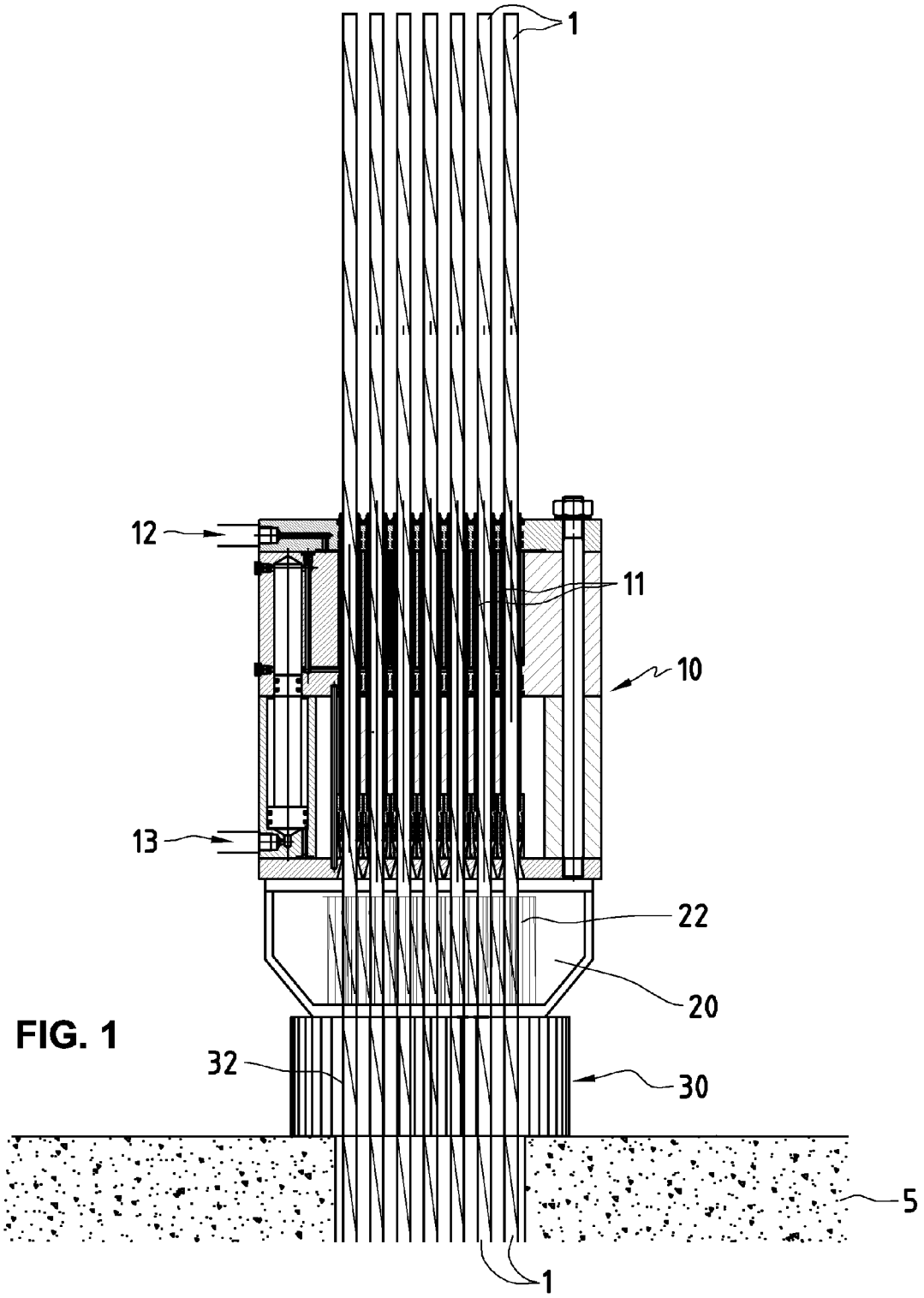
FIG. 1 shows a schematic sectional view of a first embodiment of the invention, using an array of individual tensioning jacks.

FIG. 1 shows a schematic sectional view of an apparatus according to an example of a first embodiment of the invention. Multiple strands 1 are shown emerging from a structure 5 to be stressed. The strands 1 may be fed through a duct, or the strands (in the case of stay cables, for example), may be suspended in free space between anchorage points of the structure 5 to be tensioned. The strands 1 are inserted through the structure 5, and through an anchor block 30, which has individual anchor elements 32 comprising, for example, conical wedges which grip the strand 1 as a result of tension in the strand 1. The anchor elements 32 prevent the strand 1 from returning in the direction of the concrete structure 5, while allowing movement out of the duct and away from the concrete structure 5, as the strands 1 are tensioned.

In order to minimize friction and snagging, the strands 1 are preferably fed through a path in the structure such that each of the strands 1 maintains approximately the same position in the bundle all the way through the structure, and such that the strands are aligned with corresponding openings in the equal tension jack 10 and the anchor block 30 at each end of the duct.

The strands 1 are fed through a load cell array 20, such that each strand 1 passes through a separate load cell 22. The load cells 22 can be, for example, magnetic load cells which measure changes in the electromagnetic properties of a steel strand 1 as the tension in the strand 1 changes. Other kinds of load cells 22 may be used, depending, as appropriate to the geometry of the apparatus and the material of the strands 1. The load cells 22 are normally pre-calibrated for the particular kind of strand 1 being used, or for a range of types of strand, but they may now be calibrated again on site once the strands are in position in the load cell array, ready for tensioning.

The arrangement of load cells 22 in array 20 may be better understood by referring to FIGS. 3 and 5, which will be described in more detail later. There is a corresponding arrangement of anchor elements 32 in the anchor block 30 and jacks 11 in the jack array 10.

The strands are also fed into the individual jacks 11 in the equal tension jack unit 10, which is positioned against the load cell array unit 22, ready for tensioning to begin. The number of individual jacks may be any suitable number. A tensioning bundle may comprise 55 strands, for example, arranged in a close-packed layout similar to the arrangement of load cells shown in FIG. 3 or 5; in this case the jack array 10 could also comprise 55 jacks. The cross-sectional view of seven strands in FIG. 1 is intended to correspond to a cross-section of an array of, in this example, 55 strands. Such an array of 55 strands is illustrated in FIGS. 3 and 5, which is showing a preferred layout of 55 load cells for fitting to a bundle of 55 strands. FIGS. 3 and 5 are discussed later in this text.

Equal tension jack 10 comprises multiple (eg fifty-five) individual hydraulic jacks 11 operating from the same pressure source 12, 13. One jack 11 is provided per strand 1. The individual jacks 11 may each be hydraulic stroking jacks, for example, which are capable of taking up an indefinite amount of slack in the strands 1 by repeatedly pulling the particular strand 1 back, then returning forward to perform another pulling stroke, until the tension on the strand 1 reaches the force generated by the hydraulic pressure on the corresponding hydraulic jack piston. All the hydraulic jacks 11 are substantially identical, which, since they are all fed from the same pressure sources 12 and 13 (which feed the tension stroke and the return stroke respectively, for example), means that all the jacks 11 effectively pull the separate strands 1 to the same tension.

The tensioning assembly depicted in FIG. 1 is operated as follows: first, the strands 1 are individually tensioned to a particular tension by the individual jacks 11. Then, when all the slack has been taken up, and the strands 1 have been stressed to the same common tension, the hydraulic pressure in the equal tension jack 10 at this point is recorded as a reference against which to calibrate the individual load cells 22. The hydraulic pressure can be known (by measuring and/or calculating) to a great accuracy, and so, because the dimensions and the mechanical properties (such as friction between the piston and the cylinder) of each of the individual jacks are also precisely known (each jack can be individually pre-calibrated to map hydraulic pressure against the force exerted by the jack), the expected value of the pressure in each jack 11, and hence the tension in each strand 1, can be accurately calculated and compared with the corresponding tension measurement actually made by the individual load cell 22 mounted on the strand 1 concerned. The readings from the different load cells 22 will inevitably vary slightly between one another; in the case of magnetic load cells, for example, variations can arise due to variations in temperature, or differences in the mechanical and electromagnetic properties of the steel strand.

At this stage in the tensioning process, the strands 1 are all at the same tension, and the load cells 22 have been recalibrated to this tension. The strands are also held at substantially this tension by the anchoring elements 32 in anchor block 30, so that the equal tension jack can now be removed if necessary, leaving the strands in tension, anchored by the anchor block 30, and leaving the load cell array 20 in position adjacent to the anchor block 20. Note that anchor block 30 may include springs or other biasing elements for biasing the conical wedges into their locking configuration, blocking return movement of the strands 1, such that there is insignificant return movement and/or loss of tension in the strands 1 when the jacking stress is removed.

Unless the equal tensioning process described above achieved the desired tension in the strands, it will then be necessary to perform a second tensioning operation on the strands 1 to stress them to the desired tension. Depending on the tensioning capacity of the individual jacks, this may be carried out using the same equal tension jack 10 as was used to perform the equal tensioning phase. More usually, however, the individual jacks 11 have limited tensioning capacity, and a more powerful jack, such as a long-stroke jack, for example, will be required to tension the strands 1 to their desired tension. In this case, the equal tension jack 10 is removed from the strands 1, leaving the load cell array 20 in position, and the more powerful jack may then be fitted to the strands and to the load cell array 20. Since the load cell array is not moved or disturbed during this process, the accuracy of the calibration which was performed at the conclusion of the equal tensioning process is maintained. The second, main stressing phase can then proceed with the accurately-calibrated load cell array in place to measure and monitor the individual tensions in the strands as the main stressing is performed. In this way, any unexpected changes in tension can be detected as they occur, and isolated to the particular strand(s) affected. Such an unexpected change might indicate a material failure in the strand, for example, such as a breakage or premature yielding, or it might indicate a sudden change (a drop in tension, or an unexpectedly rapidly increasing tension) following the kind of trapping discussed above. The calibrated load cell array can also be used to show that the tension distribution across the various strands remains within acceptable tolerances during and after the main stressing process. If no significant discrepancies are detected between the individual load cell outputs while the main tensioning is being performed, and/or when the strands 1 have been fully tensioned, then this can be taken as evidence that the main tensioning has passed off without any of the trapping or friction problems mentioned before. If significant discrepancies are detected between output values of individual load cells 22, on the other hand, it can be assumed that these are an indication that the tensioning may not be satisfactory, and a decision can be taken as to whether the magnitude of the variation warrants de-tensioning and re-installing the strands 1. The use of a separate load cell for each individual strand means that the tension distribution across the strands can be known accurately and completely, instead of requiring a statistical interpretation or estimate from a set of sample measurements.

The individual load cells 22 should preferably be as similar to each other as possible, especially in their response characteristics over the range of tensions which need to be monitored in the strands 1. This is so that, once the load cells 22 have been calibrated at the first known tension (ie after all the slack has been taken up, and all the individual jacks 11 have tensioned the strands 1 to their first, relatively low level tension), the load cells 22 all produce similar load/output response characteristics over the main stressing phase, with the result that differences between load cell outputs can be taken as representing differences between strand tensions.

According to a refinement of the method of the invention, the tension measurements made for each strand can further be verified or corroborated by comparing the individual measurements, or a summary function (such as a sum, mean or other statistical function) of the individual measurements with a measurement of the combined force on all the strands 1. Such a combined, or global, force measurement can be made using a load cell arranged to measure the stressing force being exerted by the main (eg long-stroke) jack used in the main stressing phase. Alternatively, the global stress measurement on the strands may be deduced from a measurement of the hydraulic pressure in the main jack (in the case of a hydraulic jack), using a pre-calibrated conversion into tension values, or by a theoretical calculation based on the geometry and dimensions of the hydraulic jack.

The above verification/corroboration step can be performed at any point in the tensioning process where a second tension value can be accurately measured or calculated (for example, where a second jack or other tensioning means is used), separately from the tensioning measurement made during the equal tensioning phase. The fact that the load cell array remains in position throughout both stressing phases, and accurately calibrated to at least one accurately-known tension value, gives a continuously reliable tension measurement across both stressing phases. Note that the first stressing phase may be regarded as an equal tension stressing phase, with each strand being stressed to the same tension, while the second stressing phase is one of equal elongation, in that the stressing takes place by equally extending the lengths of the strands.

Figure 2:
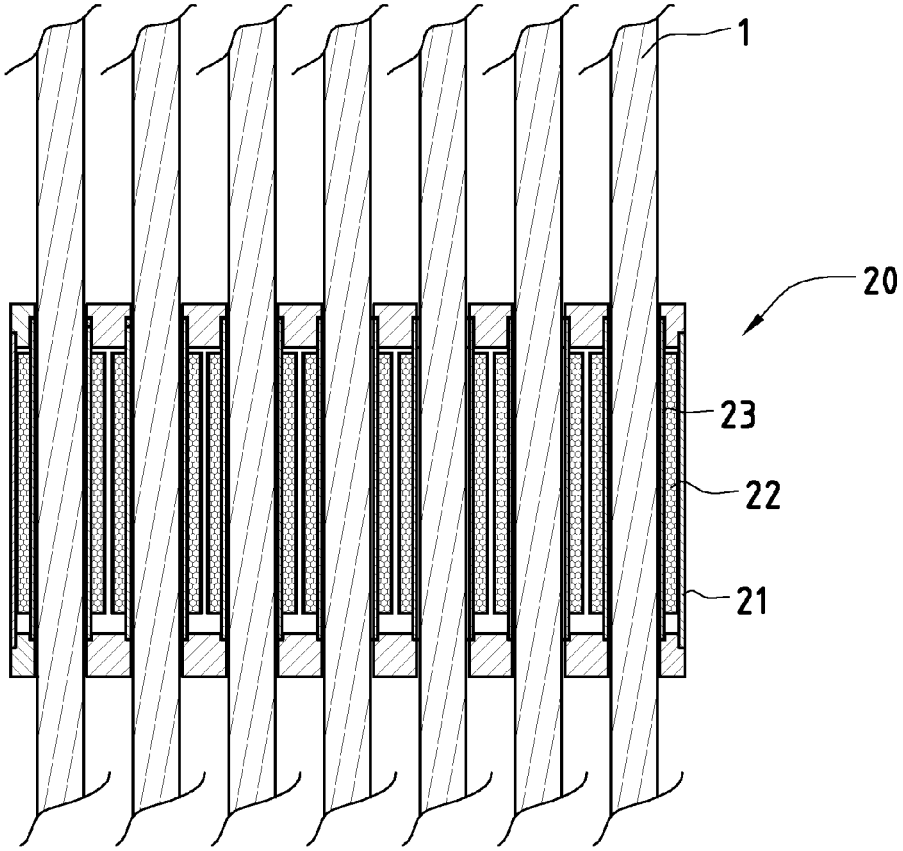
FIG. 2 shows a schematic sectional view of an array of load cells mounted around strands under tension, the load cells being arranged in a single plane.
Figure 3:
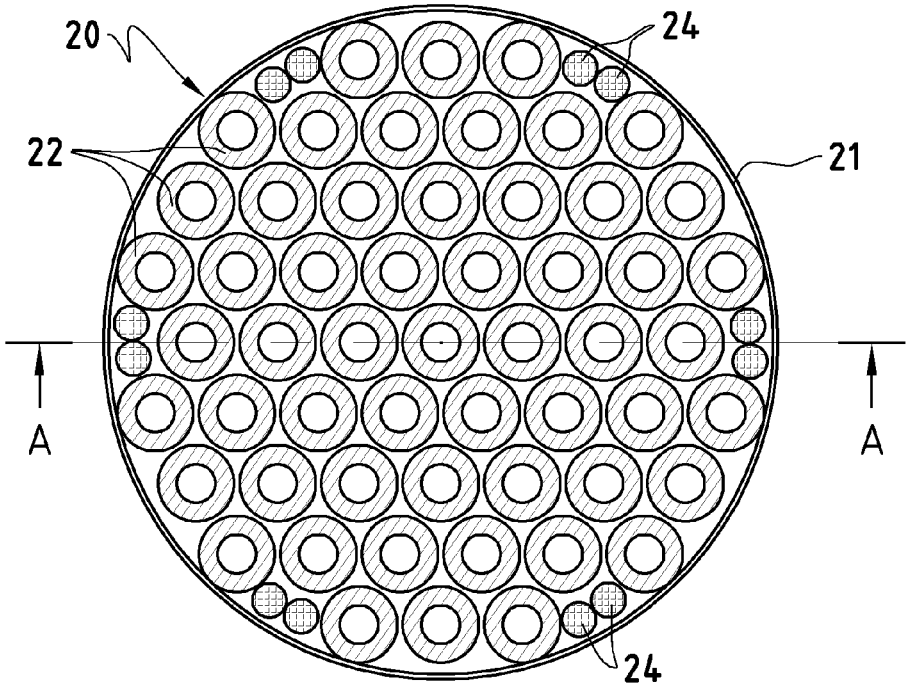
FIG. 3 shows in plan view the same array of load cells depicted in FIG. 2.
Figure 4:
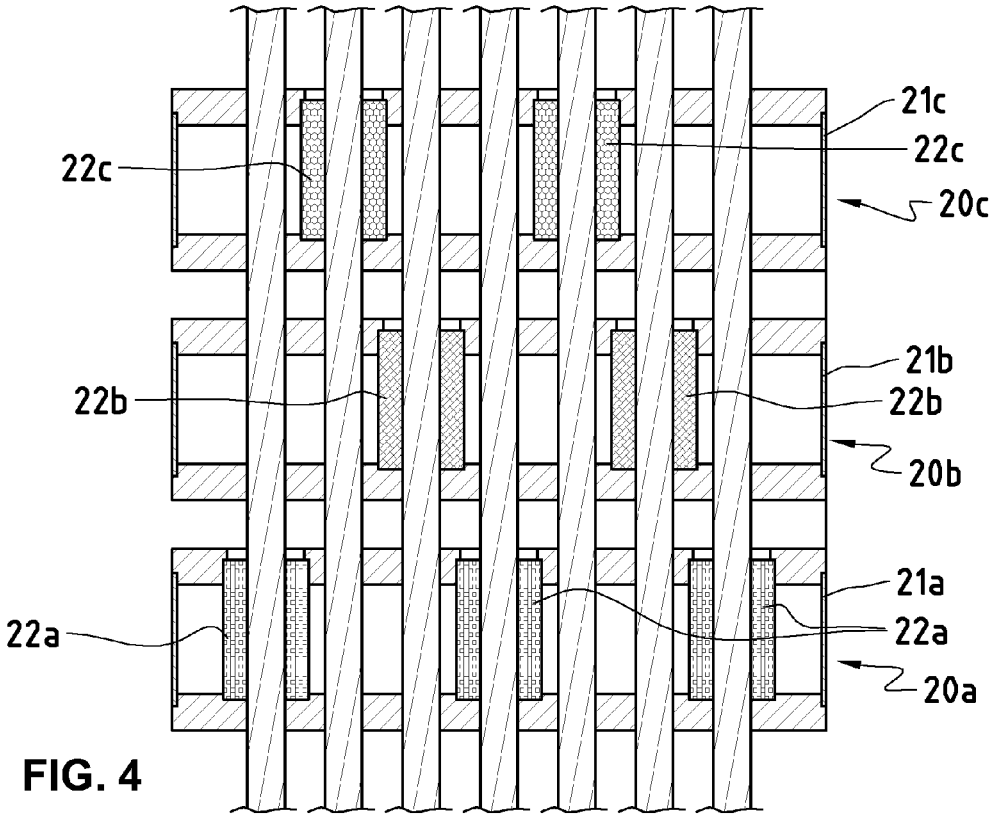
FIG. 4 shows a schematic sectional view of an array of load cells mounted around strands under tension, the load cells being offset in three planes.

FIGS. 2 to 5 show sectional and plan schematic views of two examples of load cell arrays 20 such as the one depicted in FIG. 1. FIGS. 2 and 4 represent cross-sections through the load-cell arrays of FIGS. 3 and 5 along axes A-A and B-B respectively.

In both cases, one load cell 22 is provided for each strand 1 whose tension is to be measured. The load cells 22 are preferably magnetic load cells, such as those known as elastomagnetic or magnetoelastic sensors, which are commonly implemented as two induction windings surrounding the strand 1. The two windings are not separately identified in the figures. When in use, an electrical pulse is applied to one of the windings, and the resulting induced pulse is measured across the other winding. The magnetic permeability of the steel in the strand changes with the amount of tension in the steel, so that the amount of inductive signal transfer also varies with increasing tension. Note that the magnetic permeability of the steel is also dependent on the temperature of the material, and the load cell measurements are corrected or compensated to take temperature fluctuations into account. A temperature sensor may be built into each load cell, for example, and the temperature measurement information may be output along with the tension measurement information. Alternatively, each load cell may be provided with its own temperature correction means (calculating circuitry, for example), which can be pre-calibrated to allow the correction for temperature to be performed at the load cell, so that each load cell can output a temperature-corrected tension value.

Note that other forms of load cell could be used instead of the elastomagnetic load cell, for example ultrasonic, capacitative, strain gauge etc.

FIGS. 2 and 3 show an array of 55 such load cells arranged in a single plane. The load cells 22 are shielded against external electromagnetic fields by shield 21. Wires 24 supply power to the load cells 22 and include output signal wires for conveying output values from the load cells to external monitoring or processing equipment. This planar arrangement of cells 22 is possible where the load cells 22 each have a diameter which can be fitted into the single-plane array 20 shown.

Figure 5:
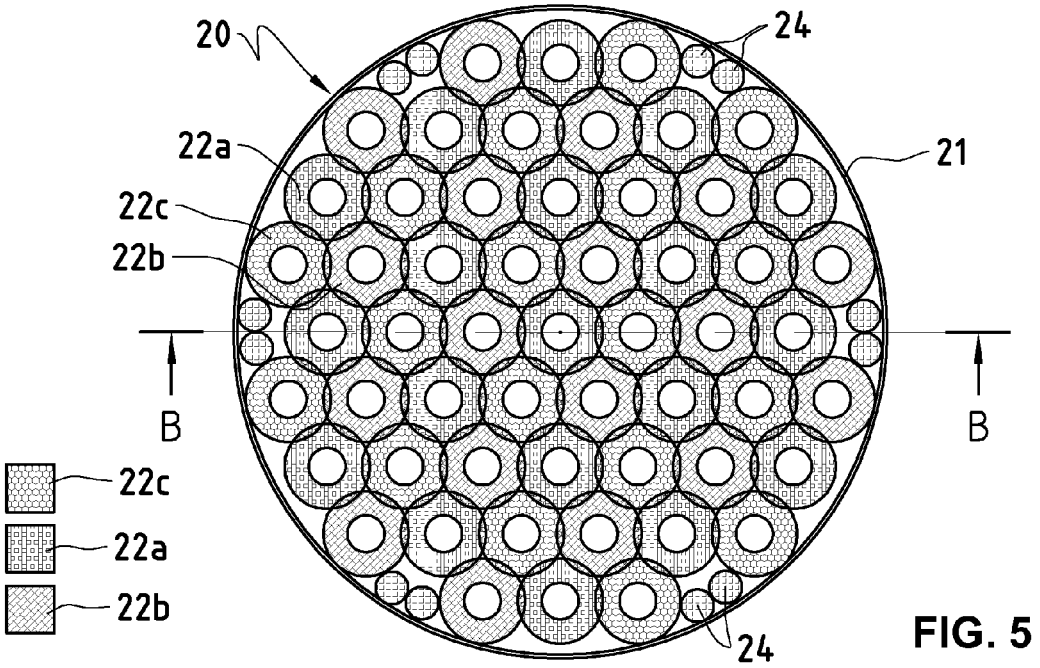
FIG. 5 shows in plan view the same array of load cells depicted in FIG. 4.

For larger load cells, or to reduce the overall diameter of the load cell array, an arrangement such as the example shown in FIGS. 4 and 5 is preferred. Alternate cells 22*a*, 22*b* and 22*c* are arranged offset in different planes so that the strands 1 can remain closer together than the load cells would permit if they were arranged in a single plane as in FIGS. 4 and 5. In the example illustrated, load cells shaded with the different shadings 22*a*, 22*b* and 22*c* are arranged in three different planar arrays 20*a*, 20*b* and 20*c* respectively. However, these arrangements are given as examples only, and other offset arrangements could be devised to suit particular load cell geometries or arrangements.

The load cell array 20 is shown in FIG. 1 as being removably mounted adjacent to the anchor block 30, on the outside of the structure being tensioned. This is so that the load cell array 20 can be removed once tensioning has been completed, and the individual strand tensions have been demonstrated to be within tolerances. However, in a variant of the invention, the load cells 22 can be located on the side of the anchor block 30 remote from the jack (this arrangement is not illustrated in the figures). In this case, the load cells 22 are used in the same way as in the method described above, except that when the tensioning is completed and the jacks have been removed, the load cells 20, 22 are left in position on the strands, with the result that the tension in individual strands 1 can be measured at any time after the jack has been removed. In this configuration, there is no change in the mechanical or electromagnetic characteristics in the vicinity of each load cell 22 once the tensioning and anchoring is complete, so any change detected in a load cell output signal can be assumed to be as a result of a change in the tension of the strand 1 around which the load cell 22 is fitted. The load cells 20, 22 can be thus left in position and used to monitor the tensions in the strands continuously or intermittently, as required. The monitoring can be performed in comparative mode, ie monitoring the relative output values of the load cells 22 and detecting differences between the tension values in the individual strands 1, or it can be in absolute mode, in which variations of the output values are tracked over time, either for individually strands 1 or for the collective bundle of strands, or both. If a "lift-off" tension measurement, or any other suitable tension check, is subsequently performed in order to verify the overall tension in the strand bundle, then the data from this measurement can be used to recalibrate the overall absolute values of the load cell array 20, or to re-verify the measurement data being provided from the load cells. If desired, the individual load cells 22 can also be normalized to the new measured value at this point, either by assuming an even distribution of force across all the strands 1, or by maintaining the same distribution of forces which was present before the lift-off test. Any unexpected change in the reading from a particular load cell will then indicate a change in the integrity of the tension in the strand being monitored by the particular load cell.

Figure 6:
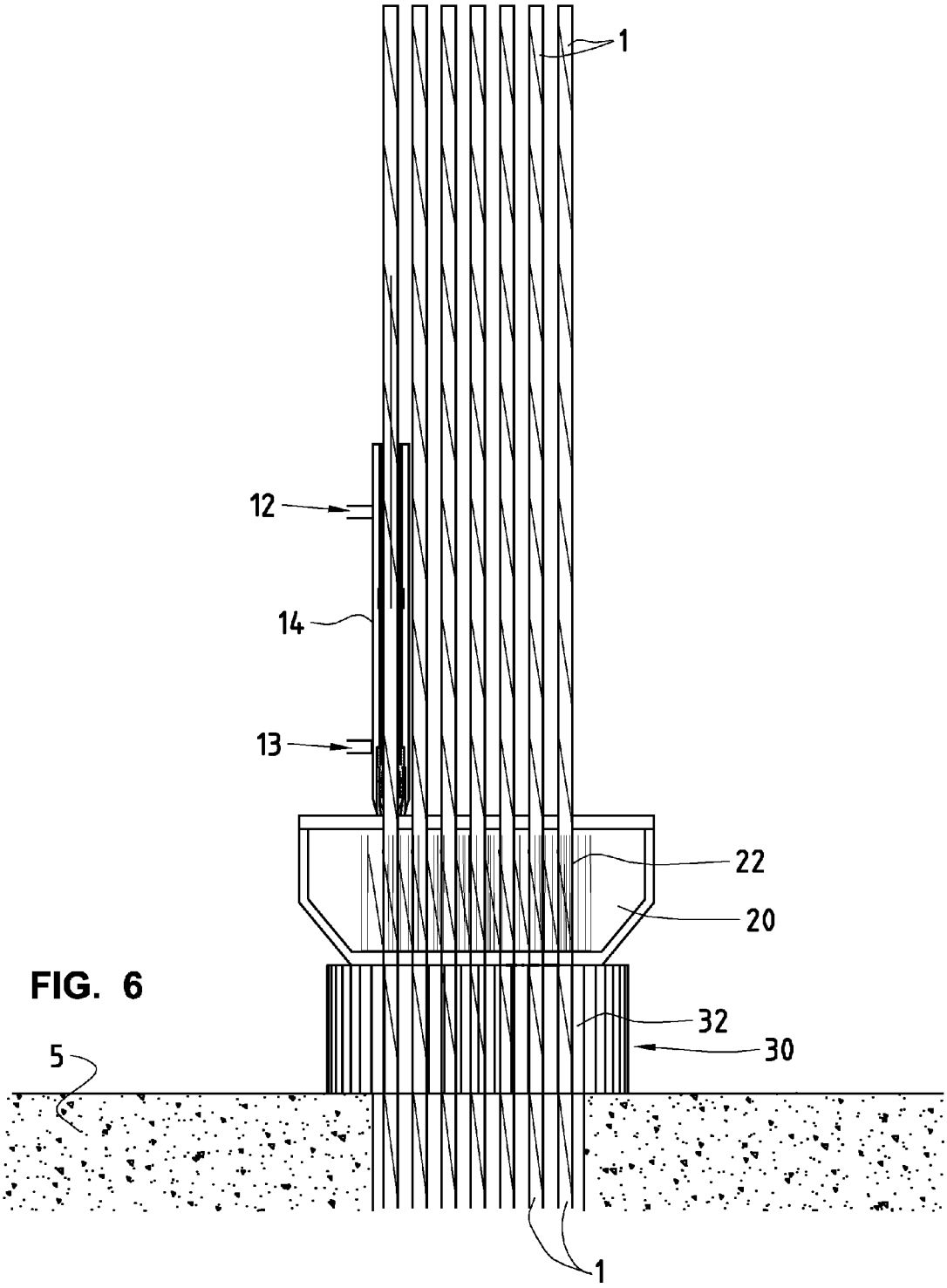
FIG. 6 shows a schematic sectional view of a second embodiment of the invention, using an individual tensioning jack.

FIG. 6 illustrates an alternative embodiment of the invention, in which the individual stressing of the individual strands 1 is performed by means of a single jack which stresses one strand 1, driven by hydraulic pressure at connections 12 and 13. The jack 14 can be moved from strand to strand until all the strands have been tensioned to the equal tensioning pressure. Since the stressing of one strand may affect the tension in other strands, the stressing of the individual strands can be repeated as often as required until it can be established that all the strands have been tensioned to the same hydraulic pressure. This equal tensioning method can be used when a full equal tension jack, as illustrated in FIG. 1, is not available on site. The principle remains the same as with the equal tension jack, however; all the strands are individually tensioned to the same tension. The calibration of the load cells 22 in load cell array 20 can then be carried out in the manner described above.

Figure 7:
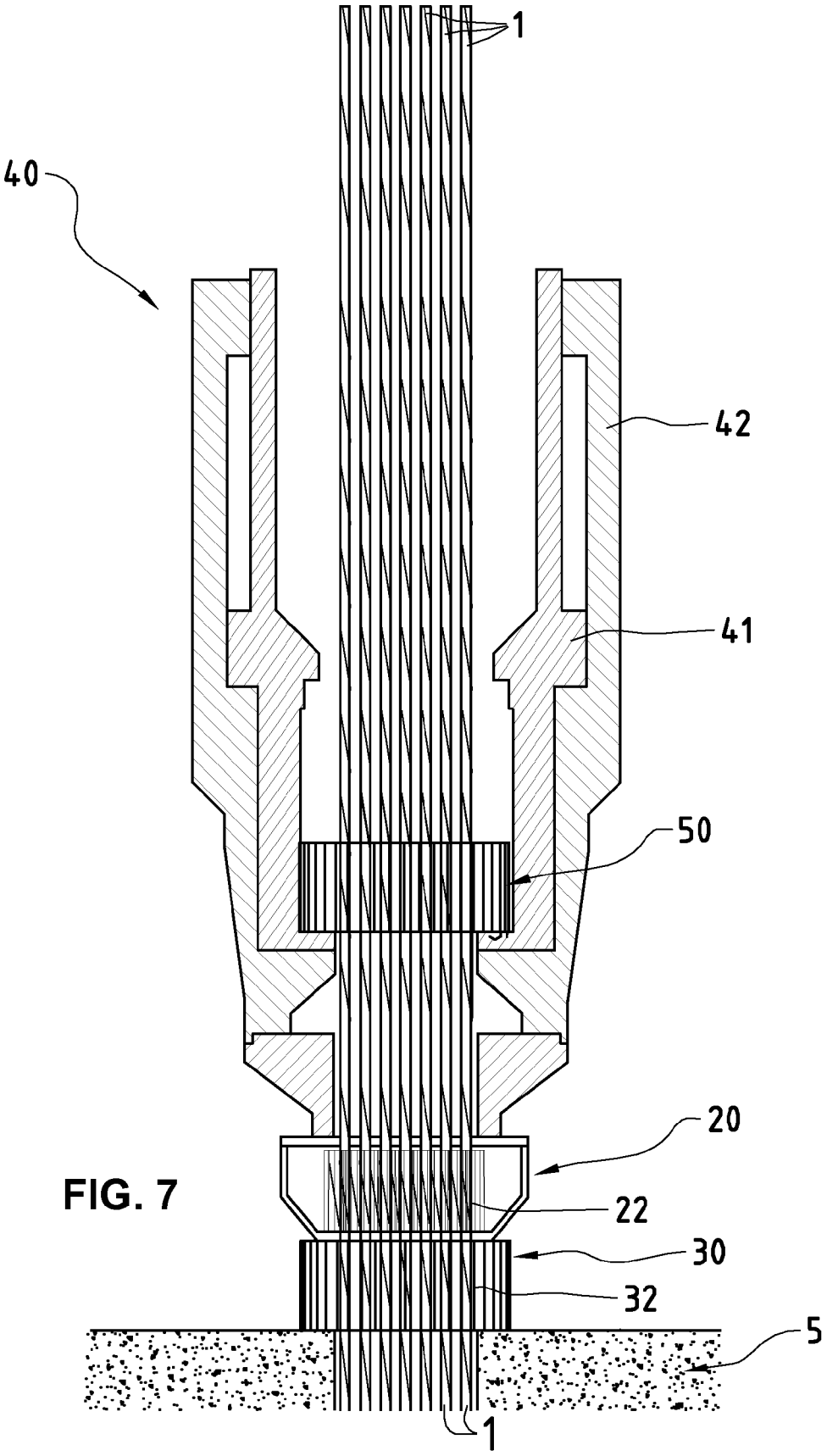
FIG. 7 shows a schematic sectional view of a variant of the invention using a second jack to provide a main tensioning phase.

FIG. 7 shows a sectional and schematic view of a long-stroke, equal elongation jack 40 which could be used to perform a second, main stressing operation in a single stroke, or in multiple jacking strokes. Jack 40 can be substituted for equal tension jack 10 as discussed earlier. Strands 1 are anchored by anchor block 30 to prevent movement of the strands in the direction opposite to the stressing direction. A second anchoring means 50 grips the strands 1 so that the jack piston 41 can be hydraulically retracted within the jack's main cylinder 42, thus applying major tension force to the strands. The tension in each strand is monitored by the load cells 22 in load cell array 20 as this main stressing takes place. The jack 40 may incorporate a global load cell, as discussed above, for measuring the tension across all of the strands being tensioned. Alternatively, this global or combined tension can be deduced from the hydraulic pressure being applied to the jack 40.

Figure 8:
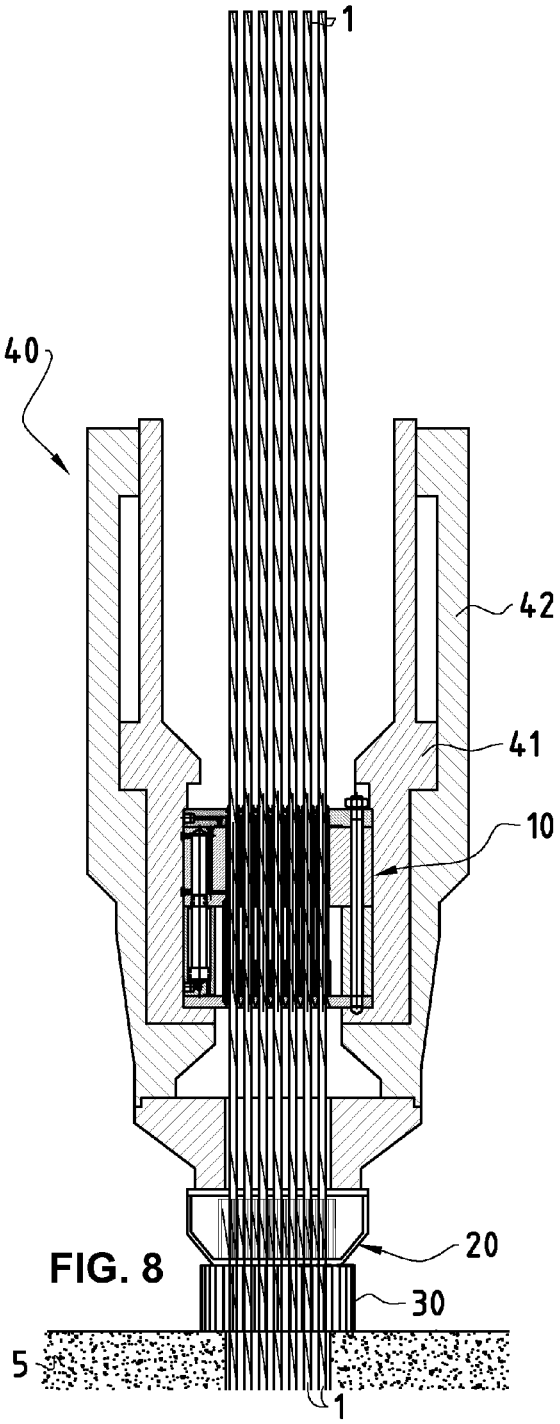
FIGS. 8 and 9 show schematic, sectional views of a further variant of the invention using an array of individual jacks and a main tensioning jack in the same unit.
Figure 9:
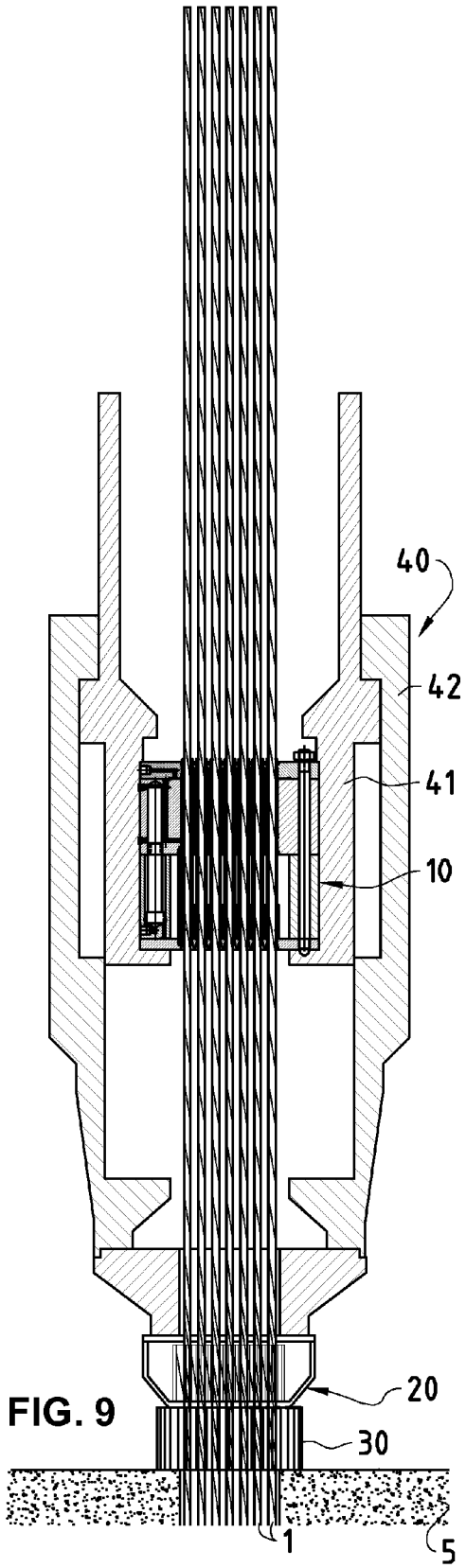

FIGS. 8 and 9 show how the individual jack array 10 of FIG. 1 (equal tension jack) can be integrated into the larger jack 40. In this case, the equal tension jack 10 would not be removed in order to be able to fit the main stressing jack 40, and both the equal tension and the main stressing operations can be performed using one piece of equipment. When this type of jack is used, the equal tension load cell calibration step mentioned earlier is performed once all the slack in the strands has been taken up by the equal tension jack 10, and all the strands have been tensioned to the same tension. FIG. 8 shows the main jack 40 in its starting position, for example while the equal tensioning and/or load cell calibration steps are being performed, while FIG. 9 shows the main jack 40 in its retracted position at the end of its pulling stroke. As a further development of this apparatus shown in FIGS. 8 and 9, a second anchor block, similar to anchor block 50 shown in FIG. 7, may be mounted behind the equal tension jack 10 (ie above the equal tension jack 10 as viewed in FIGS. 8 and 9). This second anchor block (not shown) would serve to a greater tension than can be borne by the individual anchoring means in the individual jacks of equal tension jack 10.

FIGS. 10*a* to 10*c* and 11 illustrate how the load cell calibration may be performed throughout the stressing phases. In each graph, the S axis represents the tension measurement value output from a load sensor, and the F axis represents the hydraulic pressure applied to the individual jack for the respective strand (or the tension applied to the strand, which can be deduced from the hydraulic pressure in the individual jack).

A conventional calibration is first carried out in the laboratory, for example, against a "known" reference force. This results in a calibration curve of load cell output, S, versus the actually applied force, F. Such a calibration curve for a single load cell is illustrated in FIG. 10*a*. In FIG. 10*a*, the S axis represents the output reading of the load cell being calibrated, while the F axis represents the actual force applied to the test steel used for calibrating the load cell.

On site, the stressing process takes place under conditions (the mechanical and magnetic properties of the steel, temperature etc) which are inevitably different from the original laboratory calibration conditions, and the calibration curve will need to be adjusted to take these conditions into account. Prior art methods of calibrating the load cells were limited to zeroing the load cell output at zero load conditions, and adjusting for temperature variations. The present method and system of the present invention improves on these methods by fitting the laboratory calibration curve for a load cell to a set of real measured values for each individual strand. The more values are measured, the more accurately the curve can be fitted to the measured data. An illustration of this fitting process is shown in FIG. 10*b*, which shows the original calibration curve (solid line) with two points $F_0$-$S_0$ and $F_1$-$S_1$ marked. $S_0$ and $S_1$ represent the expected tension readings from the load cell at stressing tensions $F_0$ and $F_1$ respectively. $S'_0$ and $S'_1$, on the other hand, represent the actual measured tension values indicated by the load cell at tensions $F_0$ and $F_1$ respectively (the real forces $F_0$ and $F_1$ can be known from, or calculated from, the pressure applied to the respective hydraulic jack). The dotted line is a slightly shifted and rotated version of the original calibration curve, moved so that it coincides with the actual measurement data. By fitting the curve to the actual measurements for each load cell during the equal tensioning phase, when each individual tension value can be measured for each individual strand, the individual tensions in the strands can be much more accurately modeled for tensions above the stressing range of the individual jacks 11. In this way, even though there may be no independent corroboration of individual tension readings from each individual load cell at higher tensions, the load cell readings at these higher tensions are much more accurate.

FIG. 10*c* shows a further refinement of the calibration process. In this case, $F_1$ is the tension when the first tension amount is reached (ie once all the slack has been taken up by the equal tensioning jack, and the strands are all at the same tension). By continuing the individual stressing beyond $F_1$ using the equal tensioning jack 10, further individual load cell measurements can be taken at known forces $F'_1$, $F''_1$ etc. These further measurements can be used to more accurately fit the calibration curve to the actual conditions.

FIG. 11 shows a further refinement of the calibration method. Having fitted the calibration curve for a particular load cell during the equal tensioning phase, a group verification step is carried out at $F_2$. In this step, the combined tension on the strands being tensioned is compared against a function of the individual measurement values from the individual load cells, and an expected value $S_2$ of the load cell readings is deduced. The result may simply be taken as a cross-check that the sum of the individual load cell readings equals the expected overall value $S_2$. Alternatively, the calibration curve may be further fitted to include the point $S_2$.

$S'_2$ might be a simple average value, calculated by dividing the combined tension by the number of readings, or it might be a more sophisticated mathematical function. Note that this verification step can advantageously also be carried out during the equal tension phase, to give an initial cross-calibration of the individual load-cell outputs and the tension-measuring means which is used to measure the combined tension in all the strands.

In a real situation, the tensions in the individual strands will not remain exactly the same during the main stressing operation. Slight differences in shape, material or orientation will inevitably lead to a divergence in the individual tensions as stressing proceeds after the equal tensioning operation. FIG. 12 illustrates an example of how the strand tensions (F axis) may be distributed among the numbers (N axis) of strands. $F_4$ and $F_5$ represent a variance quantity which can be used to give an indication of the spread of tension values in the strand group. Prior art systems use this kind of variance calculation to determine whether the distribution of tensions falls within a specified acceptable range for a particular post-tensioning application. However, such statistical analysis cannot rule out the possibility that one or more strands may be excessively stressed (beyond a maximum stress $F_6$, which might represent 95% of yield stress, for example), or broken (below a minimum stress $F_3$).

The method of the invention, by contrast, makes such statistical interpretations redundant, because it allows the installer to go beyond mere statements of probability, and instead to demonstrate that the strands are all individually within specified tension tolerances.

The above description has focused on tensioning one end of a group of strands. However, it may in some installations be advantageous to tension the group of strands from both ends. This can further reduce the effect of the trapping and friction problems described earlier. The strands can be tensioned using two jack assemblies—one at each end of the strand bundle. In this case, the two tensioning processes in the two jacks can proceed simultaneously, or one after the other, or incrementally, by taking turns. For the equal tension calibration to be effective, it is preferable that the calibration of the load cells in both jack assemblies is performed at the same time, after the slack has been taken up and after both jacks have tensioned the strands up to the first tension. It is also possible for the two sets of individual jacks to be driven from the same pressure source, or at least at the same pressure, as this will minimize the amount of movement of the strands within the duct. Having two sets of load cells, especially if they are all calibrated to the same tension, makes the tension monitoring system yet more sensitive to the effects of friction mentioned above. As well as comparing the output values of the load cells of one array with each other, and monitoring change in the values of the load cells over time, it is now also possible to compare the load cells of one array with the corresponding load cell (ie same strand) in the other array. A strand which becomes pinched at a point somewhere along its length, for example, will be under a higher tension at one end than the other, and this difference can be detected by comparing the two load cells at the ends of the strand. The comparison between the two load cells, or between the two arrays of load cells, can also be used to corroborate measurements made by the other kinds of comparisons mentioned.

The invention claimed is:

1. Method of tensioning a plurality of strands, the method comprising:

a first step of arranging a plurality of individual load cells so that each of the load cells can measure the individual tension in an individual strand, a second step of using an individual jack per strand to individually tension each individual strand to a common first tension amount so that all of the strands are tensioned to the common first tension amount, a third step of, when each strand is tensioned to the first tension amount, using the plurality of individual load cells to measure a first individual tension measurement value for each strand, a fourth step of calibrating the load cells having the first individual tension measurement values to the common first tension amount.

2. Method according to claim 1, further comprising a fifth step of using at least one jack to tension all of the plurality of strands at the same time to a second tension amount that is higher than the first tension amount, and a sixth step of determining, using the individual load cells, a second individual tension measurement value for each individual strand when the strands are tensioned to the second tension amount.

3. Method according to claim 1, further comprising a seventh step of arranging second load cells to determine the combined tension on the plurality of strands, and an eighth step of comparing the combined tension with individual tension measurement values detected by the first load cells.

4. Method according to claim 1, in which the individual load cells are magnetic load cells.

5. Method according to claim 1, comprising a ninth step of removing the individual load cells after the strands have been tensioned to the common first tension amount.

6. Method according to claim 1, in which the plurality of individual load cells are arranged such that they continue to provide individual tension values for the individual strands after the strands have been tensioned to the common first tension amount.

7. System for tensioning a plurality of structural strands, the system comprising:

an individual jack per strand for individually tensioning each of the strands to a common first tension amount so that all of the strands are tensioned to the common first tension amount, a common jack for tensioning all of the plurality of strands at the same time to a second tension, the second tension being higher than the first tension, the system being characterized in that it comprises a plurality of individual load cells arranged to detect individual tension measurement values for each of the strands, and first calibration means for calibrating the load cells having the individual tension measurement values to the common first tension amount.

8. System according to claim 7, in which the individual jacks comprise one or more individual hydraulic jacks, the or each individual hydraulic jack being arranged to tension one strand.

9. System according to claim 8, in which the individual jacks comprise a plurality of individual hydraulic jacks supplied by a common pressure source or by separate sources at a common pressure.

10. System according to claim 8, in which the individual jacks comprise only a single individual hydraulic jack which is transferred to successively tension one strand after another.

11. System according to claim 7, in which the individual load cells are magnetic load cells.

12. System according to claim 7, in which the individual load cells are arranged in one or more common planes orthogonal to a longitudinal axis substantially parallel to the tensioning direction of the strands.

13. System according to claim 7, in which the individual load cells are arranged such that they remain in position to measure the individual tension in the individual strands after the tensioning to the common first tension amount has been completed.

14. System according to claim 7, in which the individual jack and the common jack are part of the same device.

15. System according to claim 7, comprising common load cells for determining the common tension on the plurality of strands, and second calibration means for calibrating the individual tension measurement values determined by the individual load cells to the common tension determined by the common load cells.

16. Method according to claim 2 wherein the second step uses a plurality of jacks including the individual jack per strand, to individually tension each individual strand to the common first tension amount, and the fifth step uses one jack to tension all of the plurality of strands at the same time to the second tension amount.

17. Method according to claim 2 including using the individual load cells to monitor the individual tension measurement value for each individual strand while the strands are being tensioned up to the second tension amount and detecting any unexpected changes in tension occurring in each strand.

18. Method according to claim 1 wherein the individual load cells comprise at least one of an elastomagnetic or magnetoelastic sensor, temperature sensor, ultrasonic sensor, capacitive sensor, and strain gauge.

19. System according to claim 7 comprising a plurality of jacks including the individual jack per strand adapted to individually tension each individual strand to the common first tension amount, and the common jack is a single larger jack adapted to tension all of the plurality of strands at the same time to the second tension.

20. System according to claim 7 wherein the plurality of individual load cells are adapted to monitor the individual tension measurement value for each individual strand while the strands are being tensioned up to the second tension and to detect any unexpected changes in tension occurring in each strand.

21. System according to claim 7 wherein the individual load cells comprise at least one of an elastomagnetic or magnetoelastic sensor, temperature sensor, ultrasonic sensor, capacitive sensor, and strain gauge.

* * * * *